US006406127B1

(12) United States Patent
Mandel

(10) Patent No.: US 6,406,127 B1
(45) Date of Patent: Jun. 18, 2002

(54) HIGH PRODUCTIVITY/MULTIPASS/INK PRINTING SYSTEM AND METHOD

(75) Inventor: Barry P. Mandel, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/714,487

(22) Filed: Nov. 17, 2000

(51) Int. Cl.[7] ..... B41J 2/15
(52) U.S. Cl. ..... 347/41; 347/16
(58) Field of Search ..... 347/41, 40, 43, 347/12, 15, 16, 56, 65

(56) References Cited

U.S. PATENT DOCUMENTS 4,638,337 A 1/1987 Torpey et al. ..... 347/65
4,849,774 A 7/1989 Endo et al. ..... 347/56
5,683,188 A * 11/1997 Miyazaki et al. ..... 347/41
6,000,781 A * 12/1999 Akiyama et al. ..... 347/40
6,095,637 A * 8/2000 Hirabayashi et al. ..... 347/43

FOREIGN PATENT DOCUMENTS

JP 403208649 * 9/1991 ..... 347/43

* cited by examiner

*Primary Examiner*—Lamson D. Nguyen
(74) *Attorney, Agent, or Firm*—Oliff & Berridge, PLC

(57) ABSTRACT

Methods and systems for an ink printing system with a printhead system comprising at least two printheads with one printhead adjacent to a second printhead, the two printheads spaced such that the media can advance a full swath distance between each scan, and the swath printed by each print head system will overlap the stitch points created by each of the printheads.

10 Claims, 6 Drawing Sheets

HIGH PRODUCTIVITY/MULTIPASS/INK PRINTING SYSTEM AND METHOD

BACKGROUND OF THE INVENTION

1. Field of Invention

This invention relates to a fluid ejection system.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

SUMMARY OF THE INVENTION

As described above, inkjet printing systems usually use a single printhead, or array of colored printheads, that print a swath of information. Thus, the ink jet printer's productivity is limited to the size of the printheads used. During printing, the printheads print a swath of information. In order to increase productivity after printing a swath of information, the printheads move a full swath width relative to the printed swath of information. Thereafter, the printheads print an additional swath of information. However, the quality of printing when using this process is reduced as the opportunity to place ink drops in a given location is limited to one pass of the printhead. Another problem occurs in that stitch errors occur between each swath as the printhead fails to align with the previous swath.

One technique for dealing with this problem is to overlap adjacently produced swaths. However, overlapping the swaths reduces the productivity of the ink jet printer system, as the printhead moves in smaller increments based on the amount of desired overlap. Another technique used to improve productivity adds additional printheads by staggering the multiple printheads together or placing the additional printheads in line with the first printhead along the lines of carriage movement. However, this increases the scanning distance required to print each swath, which has a negative affect on system productivity.

This invention provides multiple pass printing with relatively small printheads and with high productivity.

This invention separately provides a fluid ejection system that can efficiently mask image quality defects that occur at the stitch point between swaths formed by individual printheads.

This invention separately provides a fluid ejection system that can advance a full swath distance between printhead scans.

In various exemplary embodiments of a fluid ejection system and methods according to this invention, the fluid ejection system includes a printhead system with at least two printheads. One printhead is located adjacent to a second printhead such that the printhead system can advance a full swath distance between each scan.

In various exemplary embodiments, a first printhead is placed less than one swath distance away from a second printhead. In other various exemplary embodiments, the first printhead is placed more than one swath distance away from the second printhead.

In various exemplary embodiments, the distance between the swaths printed by the first and second printheads is less than the swath width of at least the second printhead. In other various exemplary embodiments, the distance between the swaths printed by the first and second printheads is more than the swath width of at least the second printhead.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF PREFERRED EMBODIMENTS

Figure 1:
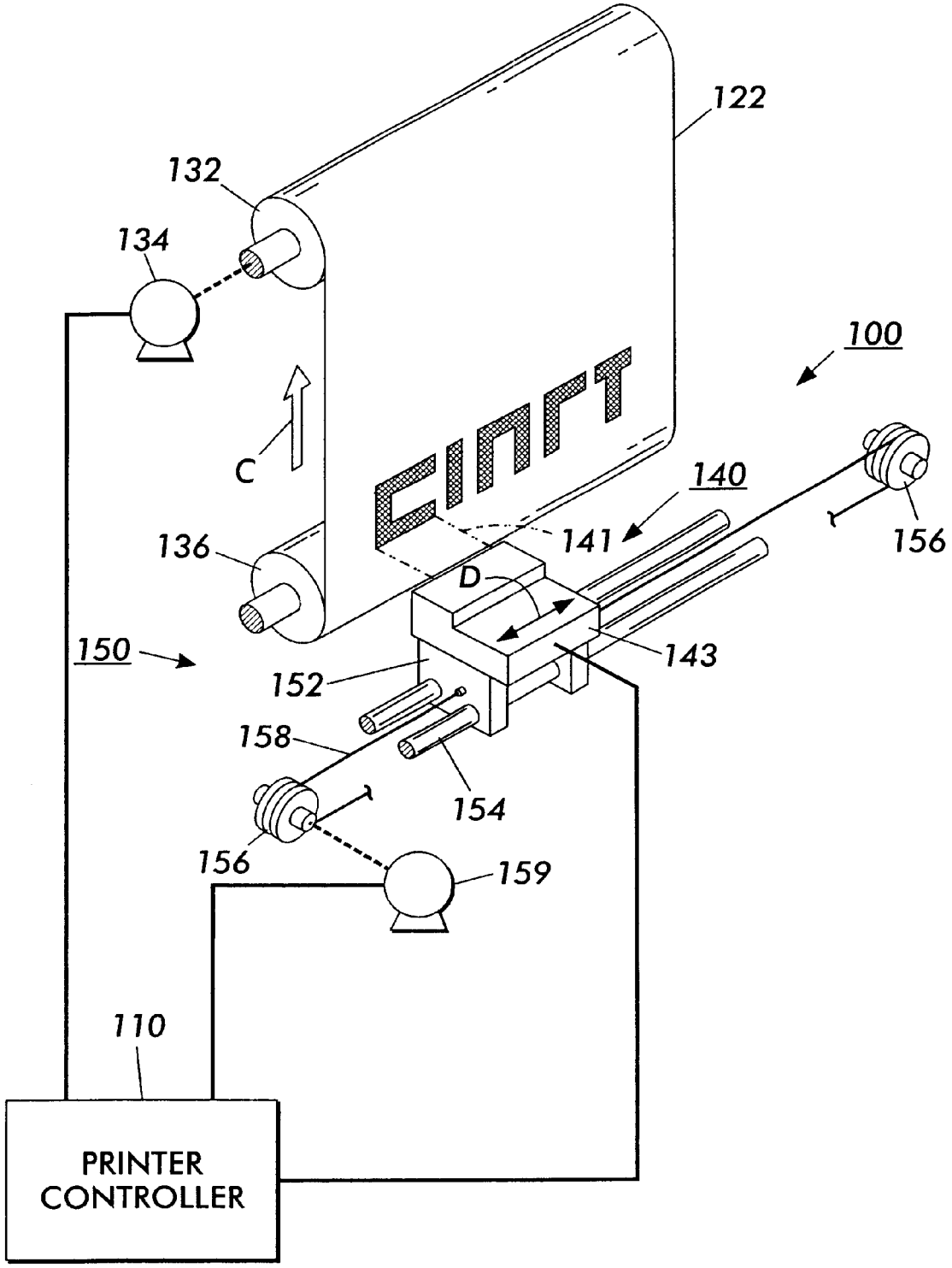
FIG. 1 is a schematic view of a printing system usable with the ink jet printing systems and methods according to this invention.

FIG. 1 shows an exemplary carriage-type fluid ejection system device 100. In various exemplary embodiments, the fluid ejection system 100 is an ink jet printing device. A linear array of droplet-producing channels is housed in a printhead 140 mounted on a reciprocal carriage assembly 143. The array extends along a first direction, indicated by the arrow C, i.e., the printing direction. In the exemplary carriage-type ink jet printing device 100 shown in FIG. 1, the printhead 140 includes two or more heads. The specific relationship between each of the heads forming the printhead 140 is discussed below with respect to FIG. 3. Ink droplets 141 are propelled onto a recording medium 122, such as a sheet of paper, that is stepped a preselected distance, which is less than or equal to the size of the array by a motor 134 in the printing direction, as indicated by the arrow C, each time the printhead 140 traverses across the recording medium 122 along the swath axis, as indicated by the arrow D. The recording medium 122 can be either cut sheets or a continuous medium, and can be stored on a supply roll 136 and stepped onto takeup roll 132 by the stepper motor 134, or can be stored in and/or advanced using other structures, apparatuses or devices well known to those of skill in the art.

The printhead 140 is fixedly mounted on a support base 152, which reciprocally moves in the swath axis D using any well known structure, apparatus or device, such as two parallel guide rails 154. A cable 158 and a pair of pulleys 156 can be used to reciprocally move the printhead 140. One of the pulleys 156 can be powered by a reversible motor 159. The printhead 140 is generally moved across the recording medium 122 perpendicularly to the direction the recording member 122 is moved by the motor 134. Of course, other structures for reciprocating the carriage assembly 143 are possible.

The fluid ejection system 100 is operated under the control of a print controller 110. The print controller 110 transmits commands to the motors 134 and 159 and to the printhead 140 to produce an image on the image recording medium 122. Furthermore, the printhead controller 110 can control the ejection of ink from the printhead 140.

Figure 2:
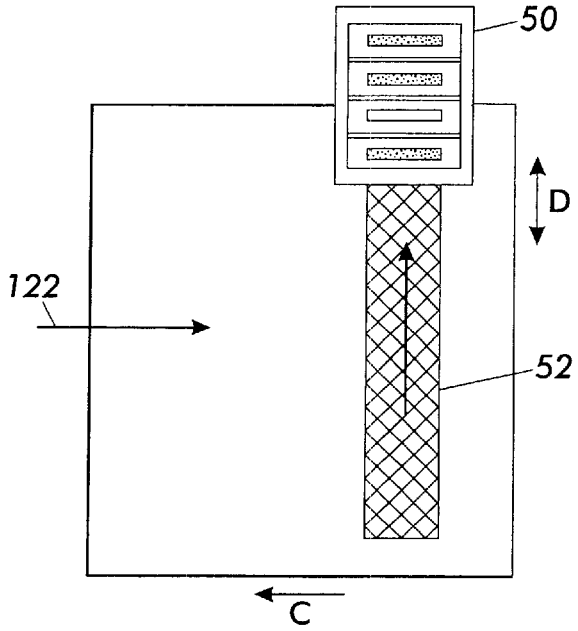
FIG.2 RELATED ART
FIG. 2 is a schematic diagram of a conventional single printhead after printing a single swath of information.

FIG. 2 shows a conventional single printhead printing a single swath 52 of ink on the recording medium 122 by ejecting ink while the printhead travels across the recording medium 122. The printhead 50 can print a swath as the printhead 50 moves in one direction along the swath axis D and thereafter in the opposite direction along the swath axis D. Alternatively, the printhead 50 could exclusively print a swath as the printhead 50 moves in one direction along the swath axis D. As should be appreciated the printhead 50 can include a plurality of printheads within the printhead 50 so as to print a plurality of colors onto a recording medium 50.

In general, as the advance distance of the recording medium 122 increases, the higher the system productivity increases. Correspondingly however, stitch errors between each swath become more visible if the printhead fails to perfectly align with the previous swath. The quality of printing with printing systems that are only a single printhead 50 is reduced as the opportunity to place ink drops in a given location is limited to one pass of the printhead.

A stitch error occurs whenever a subsequent drop ejected by the printhead 50 in one swath is displaced in any direction relative to the position that drop should occupy on the recording medium 122 relative to a previous drop ejected by the printhead 50 in a previous swath. In general, stitch errors are most noticeable when the subsequent drop is spaced too far from the previous drop along the printing direction C, such that the background color of the recording medium 122 can be seen between the two drops.

One solution to reduce stitch errors is to use a printhead 50 that can make multi-passes over a single swath before the printhead 50 advances to another swath. Alternatively, the printhead 50 could advance in increments smaller than a swath in order to obtain a greater number of passes in a given area. It should also be appreciated that the printhead 50 can advance in any number of passes in order to achieve the desired print quality. However, the conventional printing system that uses only the single printhead 50 suffers from the disadvantages discussed earlier with regards to a single printhead as the productivity of the printhead 50 is reduced in making multiple passes over a single swath, or in advancing less than a full swath in the printing direction.

Figure 3:
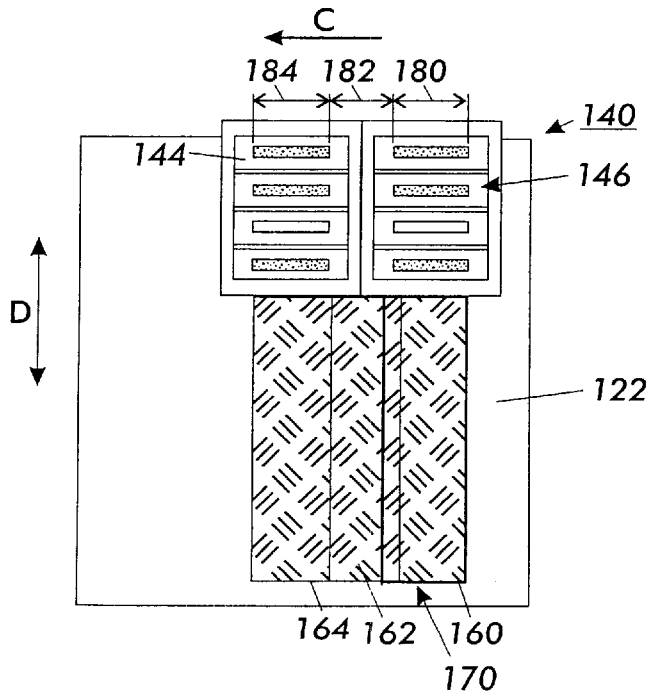
FIG. 3 is a schematic diagram of a printhead system according to this invention and a first set of swaths printed by the printhead system.

FIG. 3 shows one exemplary embodiment of a printhead according to this invention. As shown in FIG. 3, the printhead system 140 includes two printheads 144 and 146 for printing a swath of information. It should be appreciated that printheads 144 and 146 can eject ink of only one color, such as black, or could eject as a plurality of differently colored dies for full color printing. Furthermore, each of the first and second printheads 144 and 146 can scan as described above with respect to the conventional printhead 50.

The printhead system 140 moves along the swath axis D across the image recording medium 122. In a first pass, only the first printhead 144 prints a swath of the image as the printhead system 140 moves along the swath axis D. Once the first printhead 144 prints a swath 160 of the image along the swath axis D, the recording medium 122 and the printing system 140 moves relative to each other a full swath length 180 of the first printhead 144 in the printing direction C. Then, in a second pass, again only the first printhead 144 prints a second swath 162 of the image as the printhead system 140 moves along the swath axis D. The recording medium122 and the printing system 140 then again moves relative to each other a full swath length 180 of the printhead system 144 in the printing direction C. However, it should be appreciated that the printhead system 140 can advance a full swath length 180 rather than the recording medium 122.

At this time, for the third pass, and for each subsequent pass, of the printhead system 140, the second printhead system 146 is positioned at least partially over the first set of swaths 160 and 162 printed by the first printhead 144. During the third and subsequent passes, the second printhead system 146 prints swaths 170, etc. of the image that overlap the swaths 160, 162, etc. of the image printed by the first printhead 144.

As shown in FIG. 3, the swath 170 printed by the second printhead 146 overlaps the second swath 162 as well as the first swath 160 printed by the first printhead 144. This masks any stitch errors between the first and second swaths 160 and 162. As a result, stitch errors become less noticeable without having to reduce the amount the recording medium 122 and the printhead system 140 advances relative to each other in the printing direction C and without having to use the first printhead 144 to go over the same swath 160 more than once. The second printhead system 146 prints a first swath 170 of the image, such as the swath 170, along the swath axis D, as the first printhead 144 prints the third swath of the image 164. The recording medium 122 and the printhead system 140 then moves relative to each other in the full swath length 180 of the first printhead 144 in the printing direction C. As shown in FIG. 3, the first printhead 144 prints a swath of the image with the swath length 180. The second printhead 146 prints a swath of the image with a swath length 184. In various exemplary embodiments, the swath length 180 of the first printhead 144 is approximately the same as swath length 184 of the second printhead 146. However, as should be appreciated, the swath length 180 of the first printhead 144 can be larger than the swath length 184 of the second printhead 146, or vice-versa. The first and second printhead 144 and 146 are located relative to each other spaced apart by a gap 182. The gap 82 smaller than at least the swath length 184 of the second printhead 146.

Figure 4:
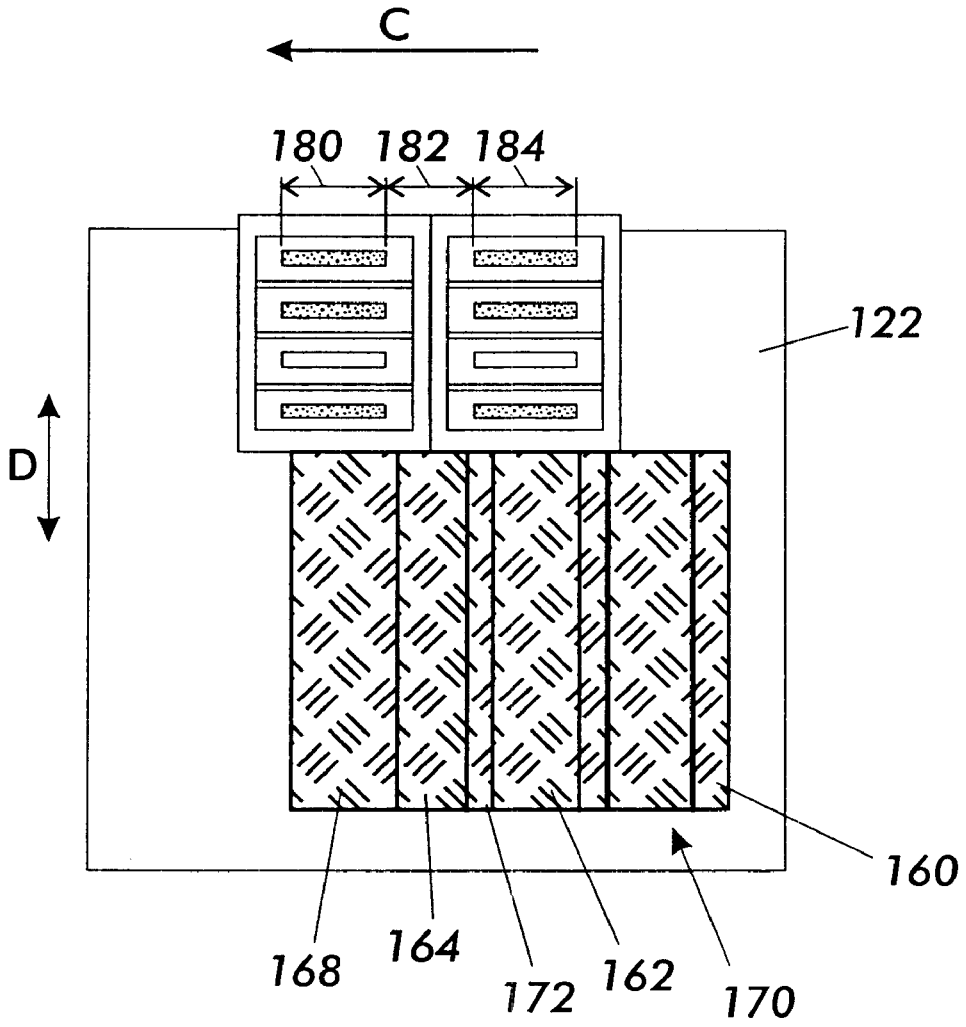
FIG. 4 is a schematic diagram of a printhead system according to this invention and a second set of swaths printed by the printhead system.

As shown in FIGS. 3 and 4 in one exemplary embodiment, the printhead system 140 moves across the image recording medium 122 along the swath axis D. As the printhead system 140 moves, the printhead 144 prints the first-fourth swath 160, 162, 164 and 166, respectively. At the same time, the second printhead 146 prints the first and second swaths 170 and 172. As shown in FIG. 3, as the first printhead 144 prints the third swath 164, the printhead 146 prints the first swath 170. Since the gap 182 has a length that is smaller than the swath width 184, the first swath 170 overlaps both of the previously printed first and second swaths 160 and 162.

The recording medium 122 and the printing system 140 then moves relative to each other a distance in the printing distance equal to the swath length 180 of the first printhead 144. Thereafter, the first and second printhead 144 and 146 print the first swaths 166 and the second 172, respectively. Since the gap 182 has a length that is smaller than the swath length 184, the second swath 172 overlaps both of the previously printed second and third swaths 162 and 164.

A similar overlapping effect could also be achieved with a gap 182 that is larger than the swath length 184 of the printhead system 146. However a slight decrease in productivity would result. The swaths printed by the printheads 144 and 146 can be greater than the swath length 184, so long as the swaths printed by the printhead 146 overlaps the swaths printed by the printhead 144. Thus, for example, as the printhead 144 prints the swath 168, the printhead 146 prints the swath 170 which overlaps the swaths 160 and 162.

Figure 5:
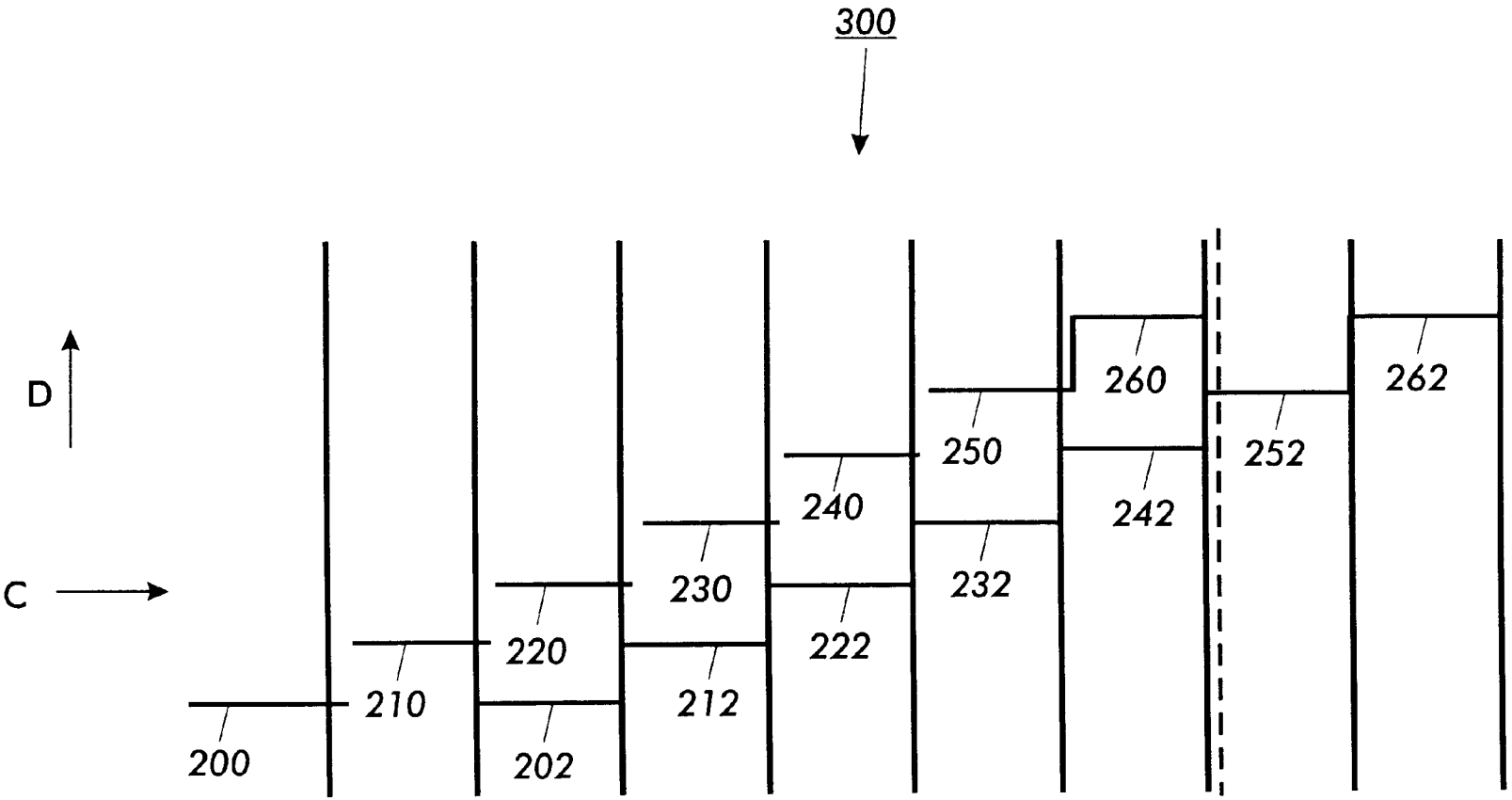
FIGS. 5–7 are exemplary embodiments of swath patterns printed by the printhead system.
Figure 6:
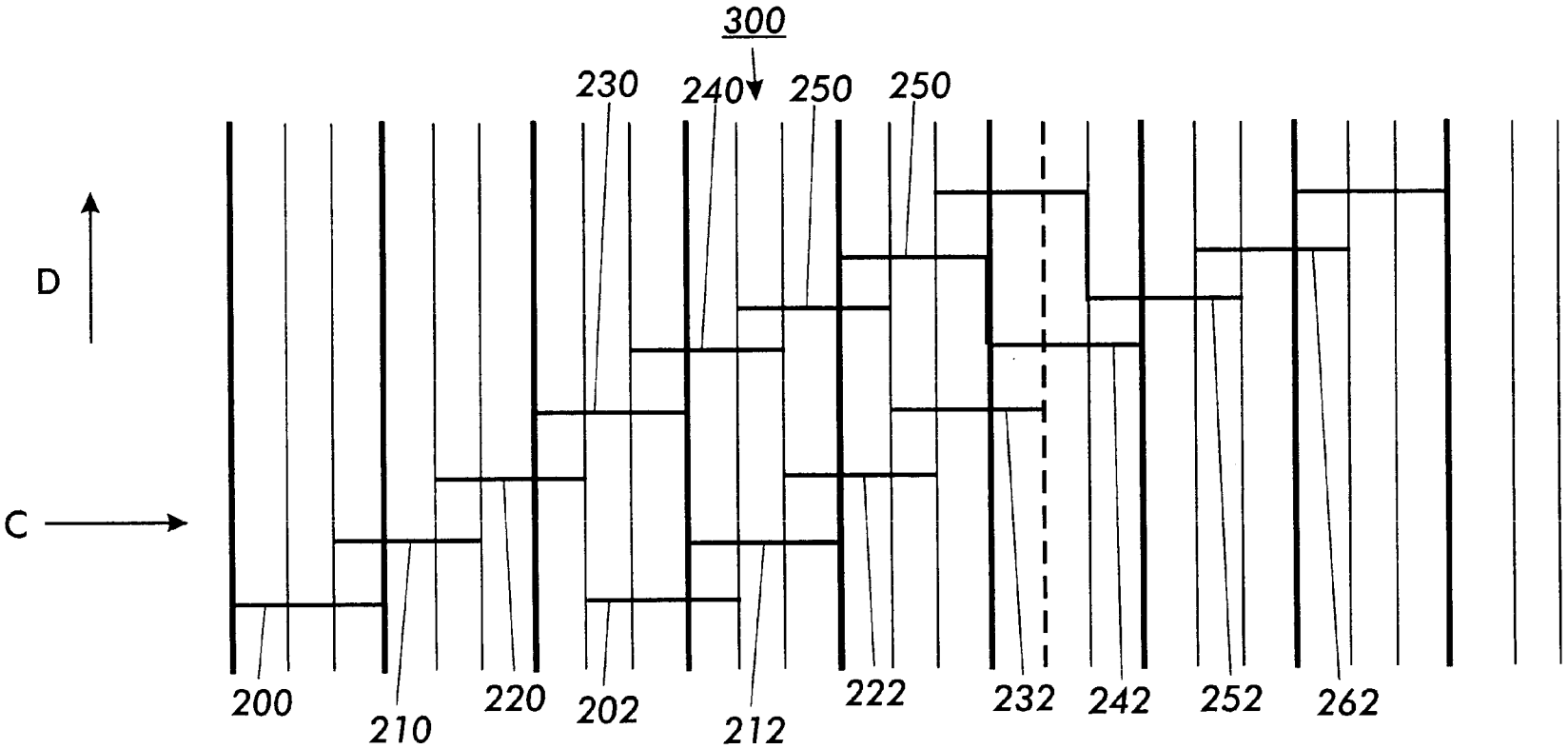
Figure 7:
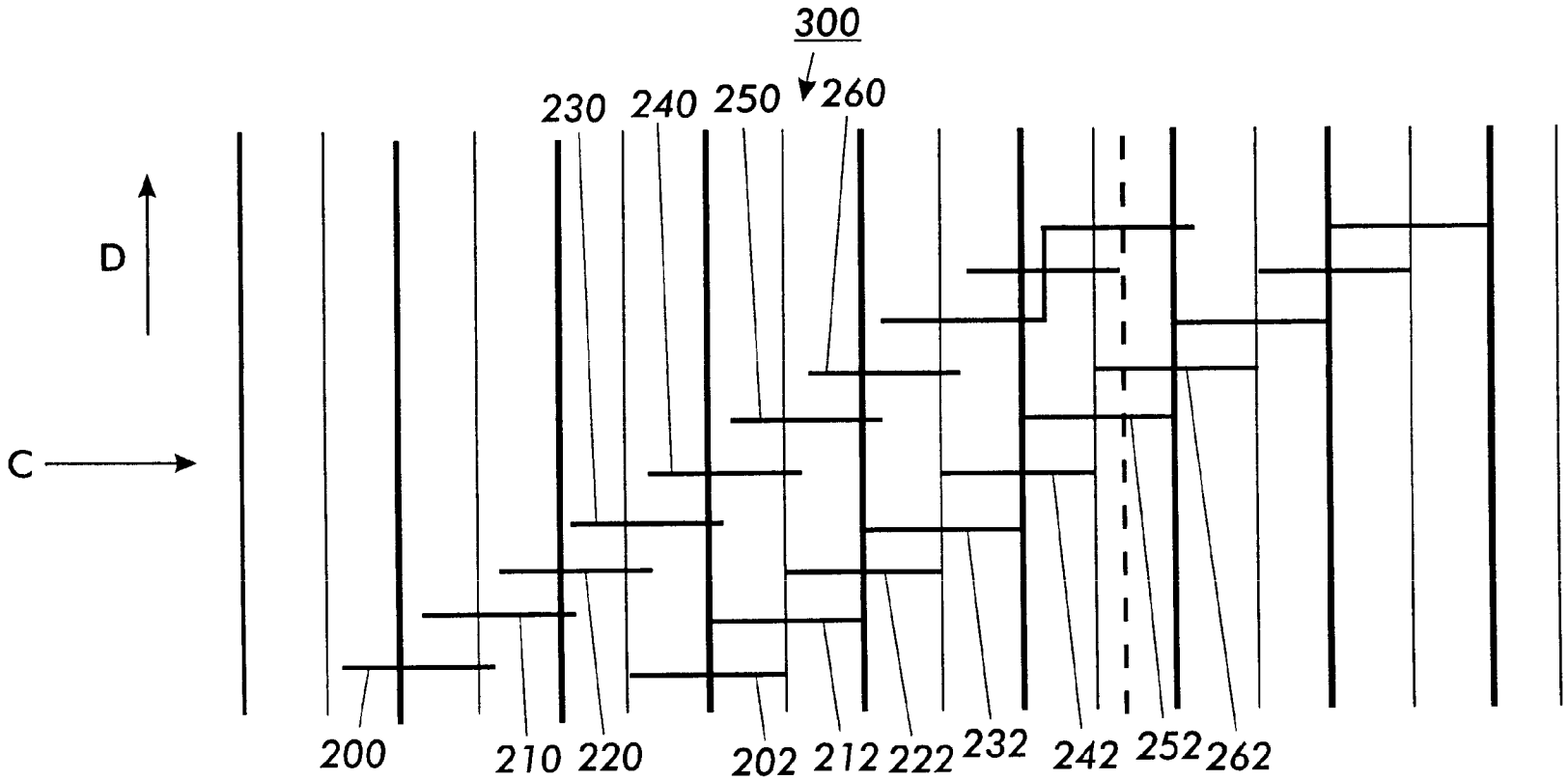

FIGS. 5–7 show exemplary embodiments of different types of gaps between the printheads 144 and 146, which can be used as well as swath advances by the printheads 144 and 146 of the printhead system 140. Swaths printed by the printheads 144 and 146 are shown incrementally advancing along the swath axis D for illustrative purposes only, as it should be appreciated that the swaths 202 and 200 can start at any location along the swath axis D. Also for illustrative purposes, the swath widths of the printheads 144 and 146 will be described as having the same width.

FIG. 5 illustrates a first exemplary embodiment having the gap 182 between the printheads 144 and 146 at 0.9 (or 90%) times the swath width, with both of the printheads 144 and 146 advancing a full swath length. After the printheads 144 and 146 print the swaths 202 and 200 along the swath axis D, the printheads 144 and 146 advance along the swath axis C by a full swath length. Thereafter, the printheads 144 and 146 print the swaths 212 and 210 along the swath axis D. This procedure is repeated until the swaths 222, 232, 242, 252, and 262 is printed by the printhead 144 and the swaths 220, 230, 240, 250, and 260 are printed by the printhead 146, as shown in FIG. 5.

It should be appreciated the two pass printing occurs as swaths printed by the printheads 144 and 146 overlap each other twice across the recording medium 122. As shown in column 300, the swath 222 is printed by the printhead 144. Additionally, approximately 0.1 (or 10%) of the swath 230 and 0.9 (or 90%) of the swath 240 printed by the printhead 146 extend into the column 300. It should also be appreciated that approximately 0.1 (or 10%) of the swath 230 and 0.9 (or 90%) of the swath 240 appear in the column 300, as the gap 182 is approximately 0.9 (or 90%) of the swath widths of the printheads 144 and 146.

FIG. 6 illustrates a second exemplary embodiment having the gap 182 between the printheads 144 and 146 equal to one and one third of the swath width, with both of the printheads 144 and 146 advancing two-thirds of the swath length. After the printheads 144 and 146 print the swaths 202 and 200 along the swath axis D, the printheads 144 and 146 advance along the swath axis C by two-thirds of the swath length. Thereafter, the printheads 144 and 146 print the swaths 212 and 210 along the swath axis D. This procedure is repeated until the swaths 222, 232, 242, 252, and 262 are printed by the printhead 144 and the swaths 220, 230, 240, 250, and 260 are printed by the printhead 146 as shown in FIG. 6.

It should be appreciated that this exemplary embodiment uses three-pass printing, as the swaths printed by the printheads 144 and 146 overlap each other three times across the recording medium 122. As shown in column 300, swath 212 is printed by printhead 144. Also, one-third of swath 202 and 222 is printed as the printhead 144 only advances two-thirds of the swath width. Additionally, two-thirds of the swath 240 and 250 is printed by the printhead 146 is printed in the column 300. As should be appreciated, approximately two-thirds of swaths 240 and 250 appear in column 300 as the gap 182 is approximately one and one-thirds that of the swath widths of the printheads 144 and 146 with the printhead 146 only advancing two-thirds of the swath width.

FIG. 7 illustrates a third exemplary embodiment with the gap 182 between the printheads 144 and 146 at 0.9 (or 90%) times the swath width with both of the printheads 144 and 146 advancing one-half of the swath length. After the printheads 144 and 146 print the swaths 202 and 200 along the swath axis D, the printheads 144 and 146 advance along the swath axis C by one-half of the swath length. Thereafter, the printheads 144 and 146 print the swaths 212 and 210 along the swath axis D. This procedure is repeated until the swaths 222, 232, 242, 252, and 262 are printed by printhead 144 and the swaths 220, 230, 240, 250, and 260 are printed by printhead 146 as shown in FIG. 7.

It should be appreciated that this exemplary embodiment uses four-pass printing as the swaths printed by the printheads 144 and 146 overlap each other four times across the recording medium 122 or at twice the rate in the exemplary embodiment shown in FIG. 5. As shown in column 300, swath 212 is printed by printhead 144. Half of the swaths 202 and 222 is also printed as the printhead 144 only advances half of a swath width. Additionally, approximately 0.1 (or 10%) of the swath 230 and 0.9 (or 90%) of the swath 250 printed by the printhead 146 appear in the column 300. Also, since the printhead 146 only advances half a swath width, 0.6 (or 60%) of the swath 240 and 0.4 (or 40%) of the swath 260 is printed in the column 300.

Thus, it should be appreciated that the first and second printheads 144 and 146 can be advanced a full swath length 180 of the first printhead 144 while reducing quality defects that occur at the stitch point between the swaths printed by each of the first and second printheads 144 and 146 respectively. Furthermore, it should also be appreciated that the first and second printheads 144 and 146 can advance a full swath length 180 of the first printhead 144 between swaths while maintaining the image quality advantages of multipass printing.

Increasing productivity using multiple small printheads is desirable when building larger build volumes of printheads already in production. This reduces part cost and enables faster design cycles with less tooling expense than would be incurred during the development of larger printheads.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid ejection system, comprising:

a printhead support structure;

a sheet of an image recording media, wherein the printhead support structure and sheet move relative to each other; and at least a first printhead and a second printhead, the first printhead and the second printhead mounted on the printhead support structure, with the first printhead mounted adjacent to and spaced from the second printhead so that its ejectors are separated from those of the second printhead by a first distance, each of the first and second printheads usable to print a swath of ink on the sheet, the swath of the printheads having a width which is not divisible by the first distance into a whole number and adjacent swaths printed by the first printhead are overlapped by a swath printed by the second printhead.

2. The fluid ejection system of claim 1, wherein the printhead support structure is movable relative to the sheet of the image recording media in a first direction.

3. The fluid ejection system of claim 2, wherein the printhead support structure is movable relative to the sheet of the image recording media in a second direction perpendicular to the first direction.

4. The fluid ejection system of claim 1, wherein the printhead support structure is a carriage.

5. The fluid ejection system of claim 1, wherein the printhead support structure is movable relative to the sheet of image recording medium by an advance system for incrementally advancing the media.

6. The fluid ejection system of claim 1, wherein the fluid ejection system is an ink printing apparatus.

7. The fluid ejection system of claim 1, wherein each of the first and second printheads print a swath having a width that is greater than the first distance.

8. The fluid ejection system of claim 1, wherein each of the first and second printheads print a swath having a width that is less than the first distance.

9. The fluid ejection system of claim 1, wherein one of the first or second printheads prints a swath having a width that is an integer multiple of the swath width of the other printhead.

10. A method of ejecting fluid onto a recording medium, comprising:

printing a first swath with a first printhead; and concurrently printing a second swath with a second printhead on a different portion of the image, where the swath width of at least the second swath is not divisible into a whole number by a distance between the first and second printheads and, with repeated printing of the first swath and the second swath, adjacent first swaths are overlapped by an overlapping second swath.

* * * * *